US006892790B2

(12) United States Patent
Czerwinski et al.

(10) Patent No.: US 6,892,790 B2
(45) Date of Patent: May 17, 2005

(54) PROCESS FOR INJECTION MOLDING SEMI-SOLID ALLOYS

(75) Inventors: Frank Czerwinski, Bolton (CA); Damir Kadak, Mississauga (CA)

(73) Assignee: Husky Injection Molding Systems Ltd., Bolton (CA)

( * ) Notice: Subject to any disclaimer, the term of this patent is extended or adjusted under 35 U.S.C. 154(b) by 0 days.

(21) Appl. No.: 10/167,478

(22) Filed: Jun. 13, 2002

(65) Prior Publication Data

US 2003/0230392 A1 Dec. 18, 2003

(51) Int. Cl.[7] ..... B22D 17/00; B22D 27/09
(52) U.S. Cl. ..... 164/113; 164/900
(58) Field of Search ..... 164/113, 312, 164/900

(56) References Cited

U.S. PATENT DOCUMENTS

| | | | | | |
|---|---|---|---|---|---|
| 4,229,210 | A | * | 10/1980 | Winter et al. | 75/10.14 |
| 4,771,818 | A | * | 9/1988 | Kenney | 164/71.1 |
| 5,900,080 | A | * | 5/1999 | Baldi et al. | 148/550 |
| 5,979,534 | A | * | 11/1999 | Shibata et al. | 164/113 |
| 6,298,901 | B1 | * | 10/2001 | Sakamoto et al. | 164/113 |
| 6,321,824 | B1 | * | 11/2001 | Fink et al. | 164/113 |
| 6,428,636 | B2 | * | 8/2002 | Doutre et al. | 148/538 |
| 2002/0007883 | A1 | | 1/2002 | Doutre et al. | 148/549 |

FOREIGN PATENT DOCUMENTS

| | | | | |
|---|---|---|---|---|
| EP | 0 968 781 A2 | * | 1/2000 | B22D/17/00 |
| WO | WO 99/20417 | | 4/1999 | B22C/3/00 |

OTHER PUBLICATIONS

R.F. Decker, 2001 honorary Alpha Sigma Mu Lecture, Materials and Process Design for Thixomolding®, 2002, pertinent page is p. 15, subsection C.

Michael M. Avedesain (ed.), ASM Specialty Handbook, Magnesium and Magnesium Alloys, 1996. pertinent pages are pp. 92 and 93.

R. D. Carnahan, R.F. Decker, R. Vining, E. Eldener, R. Kilbert & D. Brinkley, Influence of Solid Fractions on The Shrinkage of Thixomolded® MG Alloys, pertinent page is p. 1.

Raymond F. Decker, Robert D. Carnahan, Ralph Vining, Emre Eldener, Progress in Thixomolding® , 4$^{th}$ International Conference on Semisolid Processing of Alloys and Composits, Shefield, Jun. 1996, pertinent page is p. 221, col. 1, paragraph 3.

* cited by examiner

*Primary Examiner*—Kevin P. Kerns
(74) *Attorney, Agent, or Firm*—Katten Muchin Zavis Rosenman

(57) ABSTRACT

A injection-molding process injects a semi-solid slurry with a solids content ranging from approximately 60% to 85% into a mold at a velocity sufficient to completely fill the mold. The slurry is injected under laminar or turbulent flow conditions and produces a molded article that has a low internal porosity.

21 Claims, 10 Drawing Sheets

PROCESS FOR INJECTION MOLDING SEMI-SOLID ALLOYS

BACKGROUND OF THE INVENTION

1. Field of the Invention

The present invention relates generally to a process for injection molding metallic alloys and, more particularly, to a process for injection molding semi-solid alloys having a high content of solid material.

2. Related Art

Semi-solid metals processing began as a casting process developed in the early 1970s at the Massachusetts Institute of Technology. Since then, the field of semi-solid processing has expanded to include semi-solid forging and semi-solid molding. Semi-solid processing provides a number of advantages over conventional metals-processing techniques that require the use of molten metals. One advantage is the energy savings of not having to heat metals to their melting points and maintain the metals in their molten state during processing. Another advantage is the reduced amount of liquid-metal corrosion caused by processing fully molten metals.

Semi-solid injection molding (SSIM) is a metals-processing technique that utilizes a single machine for injecting alloys in a semi-solid state into a mold to form an article of a nearly net (final) shape. In addition to the advantages of semi-solid processing mentioned above, the benefits of SSIM also include an increased design flexibility of the final article, a low-porosity article as molded (i.e., without subsequent heat treatment), a uniform article microstructure, and articles with mechanical and surface-finish properties that are superior to those made by conventional casting. Also, because the entire process takes place in one machine, alloy oxidation can be nearly eliminated. By providing an ambient environment of inert gas (e.g., argon), the formation of unwanted oxides during processing is prevented and, in turn, the recycling of scrap pieces is facilitated.

The major benefits of SSIM are primarily attributed to the presence of solid particles within the slurry of alloy material to be injection molded. The solid particles are generally believed to promote a laminar flow-front during injection molding, which minimizes porosity in the molded article. The material is partially melted by heating to temperatures between the liquidus and the solidus of the alloy being processed (the liquidus being the temperature above which the alloy is completely liquid and the solidus being the temperature below which the alloy is completely solid). SSIM avoids the formation of dendritic features in the microstructure of the molded alloy, which are generally believed to be detrimental to the mechanical properties of the molded article.

According to known SSIM processes, the percentage of solids is limited to between 0.05 to 0.60. The upper limit of 60% was determined based on a belief that any higher solids content would result in a degradation in processing yield and an inferior product. It is also generally believed that the need to prevent premature solidification during injection imposes an upper limit on the solids content of 60%.

Although a 5–60% solids content is generally understood to be the working range for SSIM, it is also generally understood that practical guidelines recommend a range of 5–10% solids for injection molding thin-walled articles (i.e., articles with fine features) and 25–30% for articles with thick walls. Moreover, it is also generally believed that, for solids contents above 30%, a post-molding solution heat-treatment is required to increase the mechanical strength of the molded article to acceptable levels. Thus, although the solids content of conventional SSIM processes generally has been accepted to be limited to 60% or lower, in practice the solids content is usually kept to 30% or lower.

SUMMARY OF INVENTION

In view of the limitations of conventional SSIM processes discussed above, the present invention provides a process for injection-molding alloys of ultra-high solids contents, in excess of 60%. In particular, the present invention relates to a process for injection-molding magnesium alloys of solids contents ranging from 60–85% to produce high-quality articles of uniform microstructure and low porosity. The ability to injection mold high-quality articles using ultra-high solids contents enables the process to use less energy than conventional SSIM processes, and also to produce articles of near net shape with reduced shrinkage caused by solidification of liquids.

According to an embodiment of the present invention, an injection molding process includes the steps of: heating an alloy to create a semi-solid slurry with a solids content ranging from approximately 60% to 75%; and injecting the slurry into a mold at a velocity sufficient to completely fill the mold. The alloy is a magnesium alloy and the process produces a molded article with a low internal porosity. According to a preferred embodiment the mold is filled with the slurry in a mold-filling time of 25 to 100 ms.

According to another embodiment of the present invention, an injection molding process includes the steps of: heating an alloy to create a semi-solid slurry with a solids content ranging from approximately 75% to 85%; and injecting the slurry into a mold at a velocity sufficient to completely fill the mold. The alloy is a magnesium alloy and the process produces a molded article with a low internal porosity. According to a preferred embodiment the mold is filled with the slurry in a mold-filling time of 25 to 100 ms.

According to yet another embodiment of the present invention, an injection molding process includes the steps of: heating an alloy to create a semi-solid slurry with a solids content ranging from approximately 60% to 85%; and injecting the slurry into a mold. Preferably, injection the slurry is injected under non-turbulent flow conditions, although turbulent flow conditions are also acceptable. The alloy is a magnesium alloy and the process produces a molded article with a low internal porosity. According to a preferred embodiment the mold is filled with the slurry in a mold-filling time of 25 to 100 ms.

According to still another embodiment of the present invention, an injection-molded article is provided, wherein the article is produced by heating an alloy to create a semi-solid slurry with a solids content ranging from approximately 60% to 75%; and injecting the slurry into a mold at a velocity sufficient to completely fill the mold. According to a preferred embodiment the mold is filled with the slurry in a mold-filling time of 25 to 100 ms.

According to another embodiment of the present invention, an injection-molded article is provided, wherein the article is produced by heating an alloy to create a semi-solid slurry with a solids content ranging from approximately 75% to 85%; and injecting the slurry into a mold at a velocity sufficient to completely fill the mold. According to a preferred embodiment the mold is filled with the slurry in a mold-filling time of 25 to 100 ms.

According to yet another embodiment of the present invention, an injection-molded article is provided, wherein the article is produced by heating an alloy to create a semi-solid slurry with a solids content ranging from approximately 60% to 85%; and injecting the slurry into a mold under turbulent flow conditions. According to a preferred embodiment the mold is filled with the slurry in a mold-filling time of 25 to 100 ms.

According to yet another embodiment of the present invention, an injection-molded article is provided, wherein the article is produced by heating an alloy to create a semi-solid slurry with a solids content ranging from approximately 60% to 85%; and injecting the slurry into a mold under laminar flow conditions. According to a preferred embodiment the mold is filled with the slurry in a mold-filling time of 25 to 100 ms.

According to another embodiment of the present invention, an injection-molding process includes the steps of: providing chips of a magnesium-aluminum-zinc alloy; heating the chips to a temperature between a solidus temperature and a liquidus temperature of the alloy to create a semi-solid slurry with a solids content ranging from approximately 75% to 85%; and injecting the slurry into a mold at a gate velocity appropriate to completely fill the mold within a time period of approximately 25 ms.

These and other objects, features, and advantages will be apparent from the following description of the preferred embodiments of the present invention.

BRIEF DESCRIPTION OF THE DRAWINGS

The present invention will be more readily understood from a detailed description of the preferred embodiments considered in conjunction with the following figures.

DETAILED DESCRIPTION OF THE PREFERRED EMBODIMENTS

Figure 1:
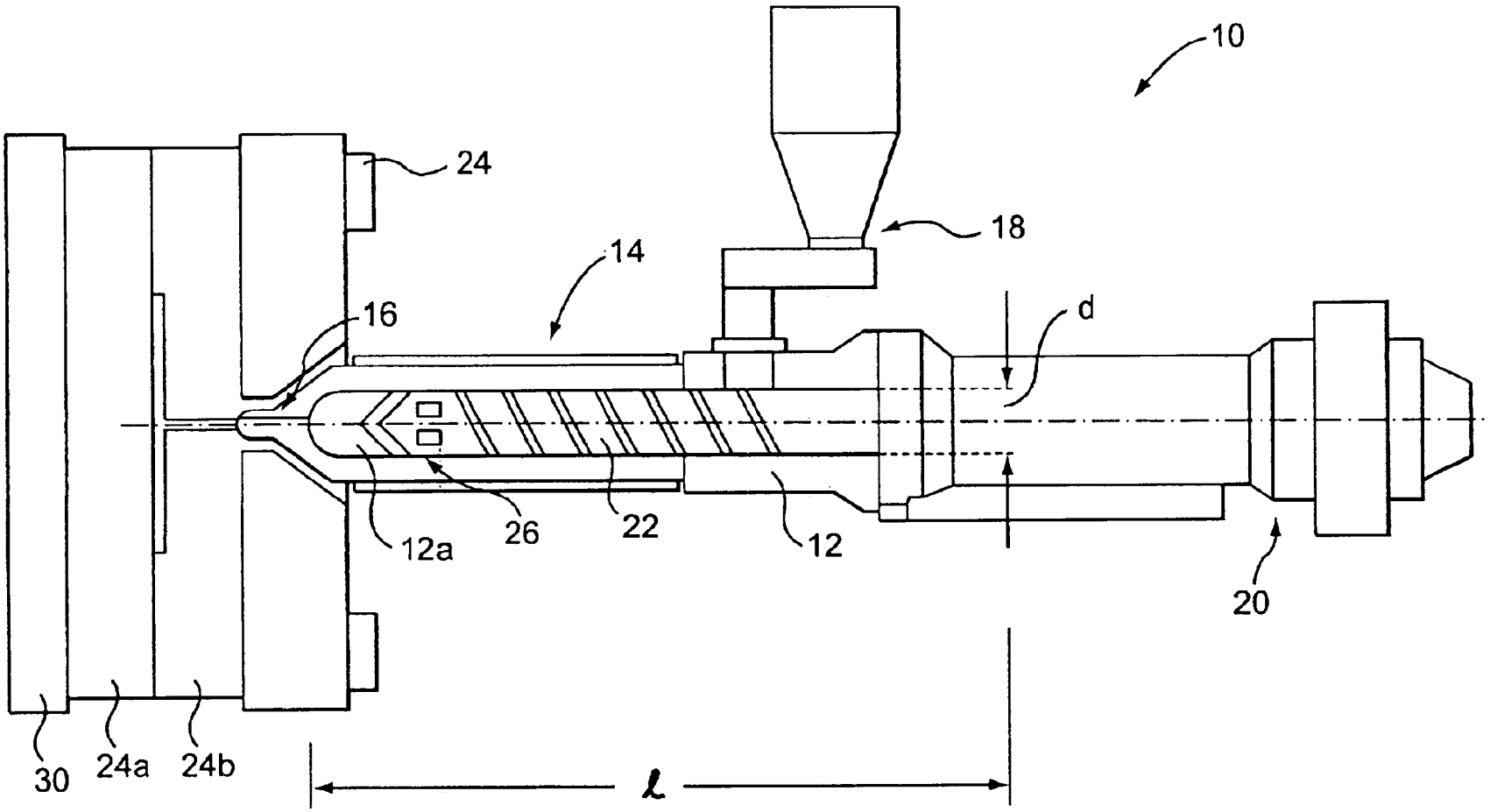
FIG. 1 schematically shows an injection-molding apparatus used in an embodiment of the present invention.

FIG. 1 schematically shows an injection-molding apparatus 10 used to perform SSIM according to the present invention. The apparatus 10 has a barrel portion 12 with a diameter d of 70 mm and a length l of approximately 2 m. A temperature profile of the barrel portion 12 is maintained by electrical resistance heaters 14 grouped into independently controlled zones along the barrel portion 12, including along a barrel head portion 12*a* and a nozzle portion 16. According to a preferred embodiment, the apparatus 10 is a Husky™ TXM500-M70 system.

Solid chips of alloy material are supplied to the injection-molding apparatus 10 through a feeder portion 18. The alloy chips may be produced by any known technique, including mechanical chipping. The size of the chips is approximately 1–3 mm and generally is no larger than 10 mm. A rotary drive portion 20 turns a retractable screw portion 22 to transport the alloy material along the barrel portion 12.

In a preferred embodiment, a magnesium alloy is injection molded. The alloy is an AZ91D alloy, with a nominal composition of 8.5% Al, 0.75% Zn, 0.3% Mn, 0.01% Si, 0.01% Cu, 0.001% Ni, 0.001 Fe, and the balance being Mg (also referred to herein as Mg-9% Al-1% Zn). It should be understood, however, that the present invention is not limited to the SSIM of magnesium alloys but is also applicable to SSIM of other alloys, including Al alloys.

Figure 2:
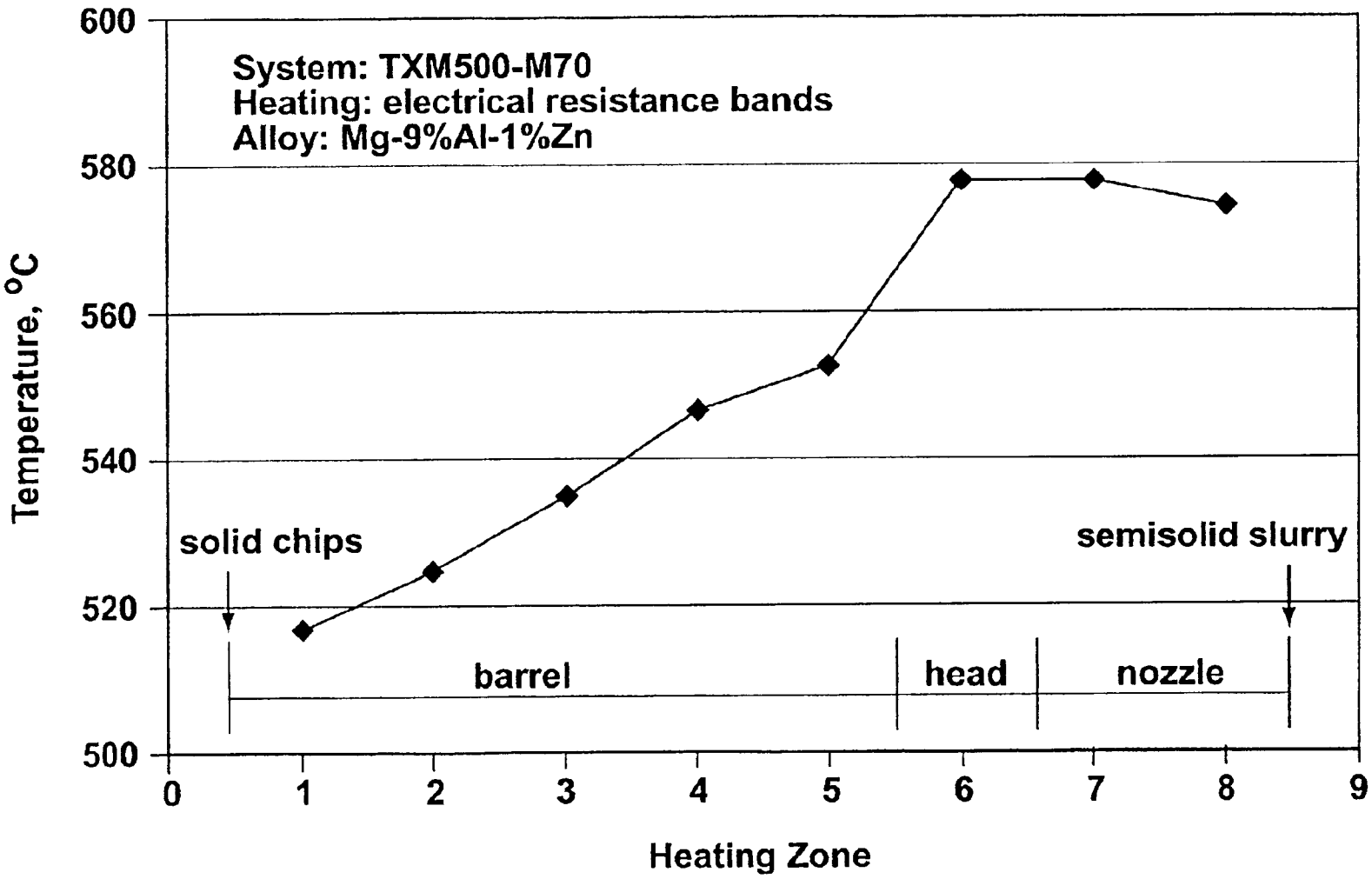
FIG. 2 is a chart showing a temperature distribution along a barrel portion of the injection-molding apparatus of FIG. 1 during processing.

The heaters 14 heat the alloy material to transform it into a semi-solid slurry, which is injected through the nozzle portion 16 into a mold 24. The heaters 14 are controlled by microprocessors (not shown) programmed to establish a temperature distribution within the barrel portion 12 that produces an unmelted (solid) fraction greater than 60%. According to a preferred embodiment, the temperature distribution produces an unmelted fraction of 75–85%. FIG. 2 shows an example of a temperature distribution in the barrel portion 12 for achieving an unmelted fraction of 75–85% for an AZ91D alloy.

Motion of the screw portion 22 acts to convey and mix The slurry. A non-return valve 26 prevents the slurry from squeezing backwards into the barrel portion 12 during injection.

The internal portions of the apparatus 10 are kept in an inert-gas ambient to prevent oxidation of the alloy material. An example of a suitable inert gas is argon. The inert gas is introduced via the feeder 18 into the apparatus 10 and displaces any air inside. This creates a positive pressure of inert gas within the apparatus 10, which prevents the back-flow of air. Additionally, a plug of solid alloy, which is formed in the nozzle portion 16 after each shot of alloy is molded, prevents air from entering the apparatus 10 through the nozzle portion 16 after injection. The plug is expelled when the next shot of alloy is injected and is captured in a sprue post portion of the mold 24, discussed below, and subsequently recycled.

In practice, the screw portion 22 is rotated by the rotary drive portion 20 to transport the alloy chips from the feeder 18 into the heated barrel portion 12, the temperature distribution in the barrel portion 12 is maintained to produce a semi-solid slurry shot with a solids content greater than 60%. The rotation of the screw portion 22 during transport mechanically mixes the slurry shot, which creates shear forces, as discussed below. The slurry shot is then transported through the barrel head portion 12*a* to the nozzle portion 16 from which the slurry shot is injected into the mold 24 by advancement of the screw portion 22 by drive portion 20.

Once the slurry shot has been injected, the rotary drive portion 20 rotates the screw portion 22 and the transport of alloy chips for the next shot begins. As mentioned above, the solid plug formed at the nozzle portion 16 after each shot of alloy is molded prevents air from entering the apparatus 10 while the mold 24 is opened to remove the molded article.

The rotary drive portion 20 is controlled by a microprocessor (not shown) programmed to reproducibly transport each shot through the barrel portion 12 at a set velocity, so that the residence time of each shot in the different temperature zones of the barrel portion 12 is precisely controlled, thus reproducibly controlling the solids content of each shot.

The mold 24 is a die-clamp type mold, although other types of molds may be used. As shown in FIG. 1, a die clamp portion 30 clamps two sections 24*a*, 24*b* of the mold 24 together. The applied clamp force is dependent on the size of the article to be molded, and ranges from less than 100 metric tons to over 1600 metric tons. For a standard clutch housing, typically made by die casting, a clamp force of 500 metric tons is applied.

Figure 4A:
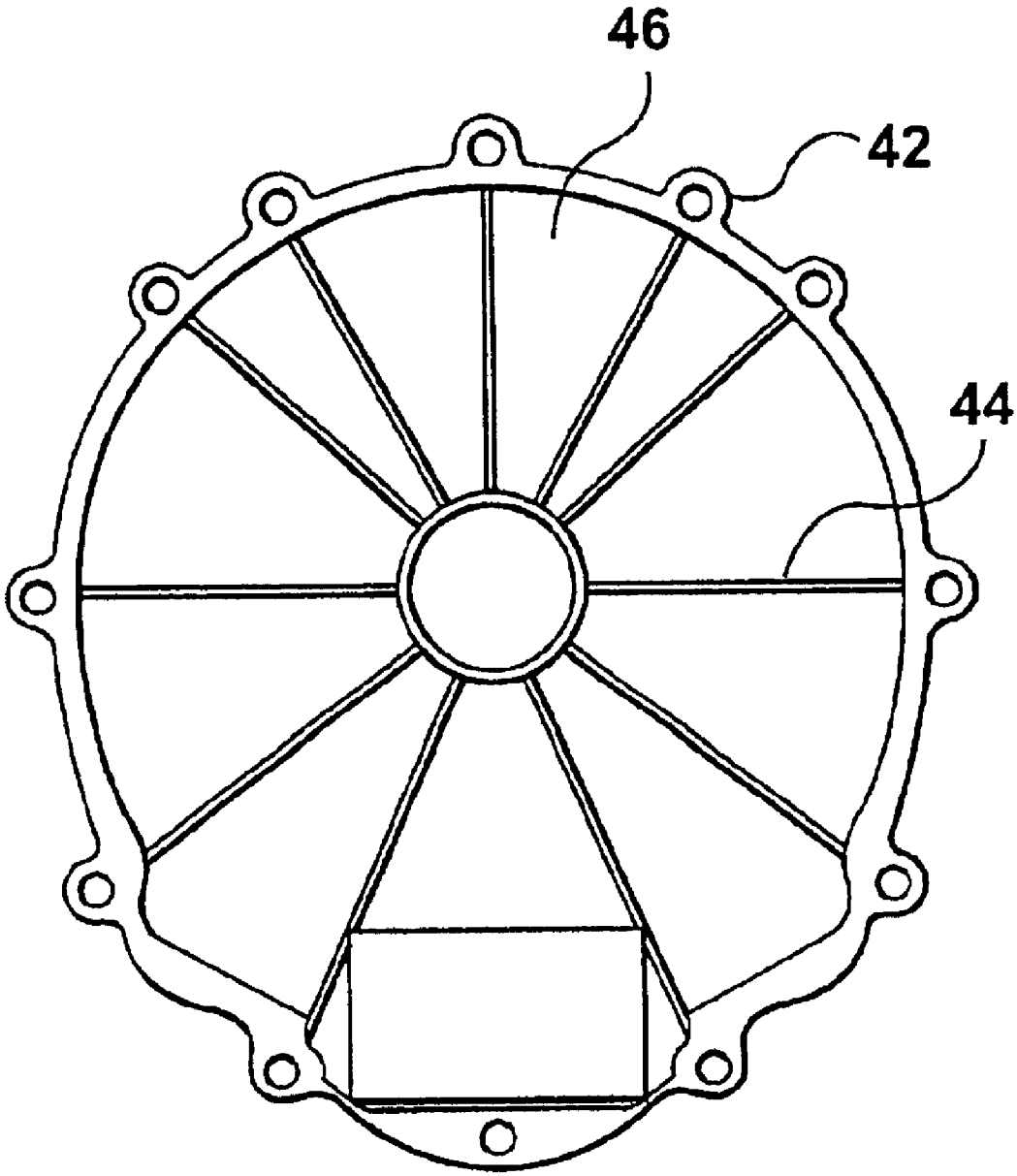
FIG. 4*a* is a plan-view diagram of a clutch housing molded according to an embodiment of the present invention.
Figure 4B:
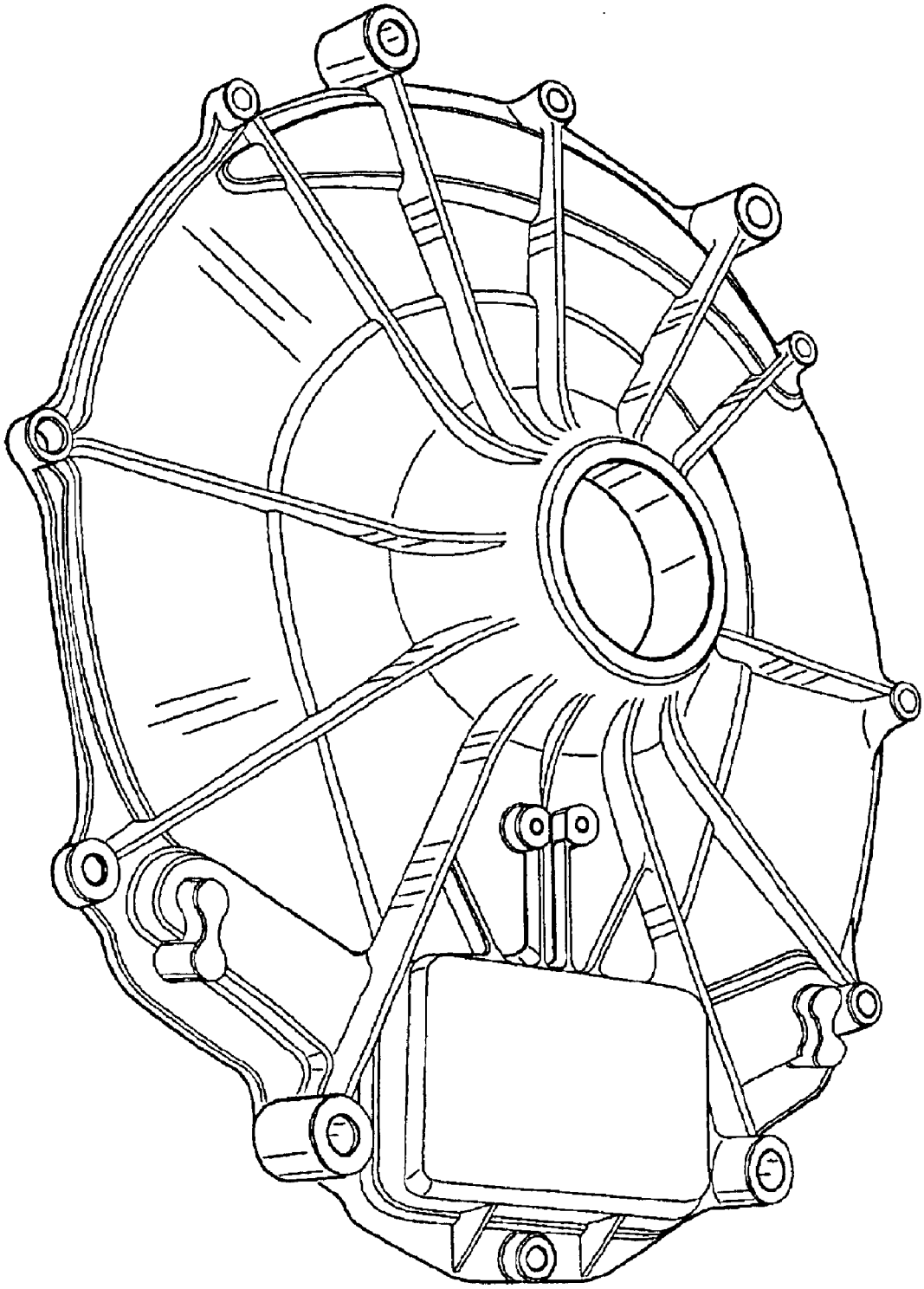
FIG. 4*b* is a perspective view of a molded clutch housing.

FIG. 4*a* is a plan-view diagram of a clutch housing 42 molded according to the present invention, and FIG. 4*b* shows a perspective view of a molded article. The clutch housing 42 is a useful structure for examining and assessing SSIM processes, because it has both thick-walled rib sections 44 and a thin-walled plate section 46.

Figure 3:
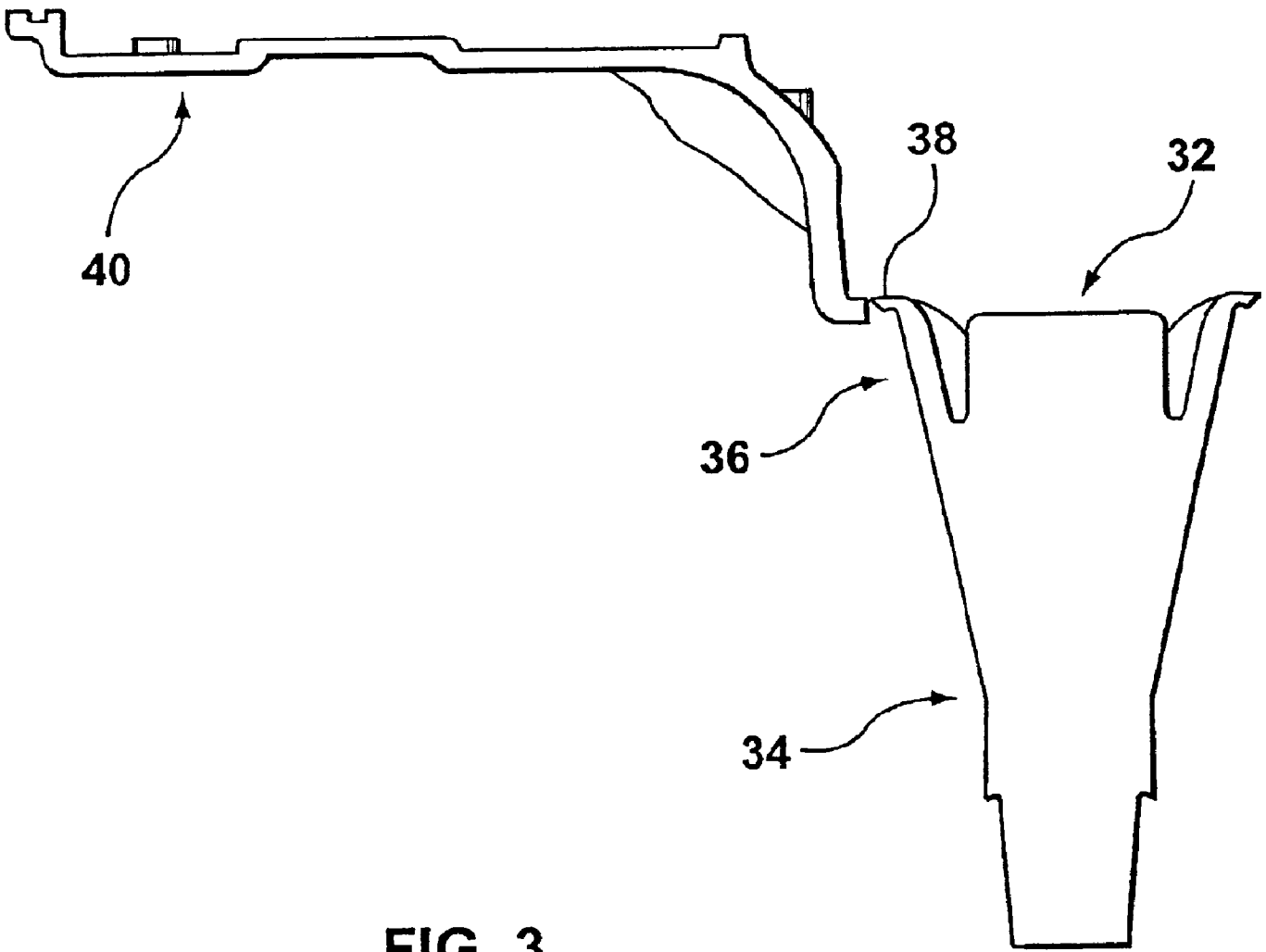
FIG. 3 is a cross-sectional view showing details of an injection-molded article.

FIG. 3 is a cross-sectional view showing portions of a molded unit formed by the mold 24. The molded unit illustrates various portions of the mold 24. A sprue portion 34 is positioned opposite the nozzle portion 16 of the apparatus 10, and includes the sprue post portion 32, discussed above, and a runner portion 36. The runner portion 36 extends to a gate portion 38, which interfaces a part portion 40 corresponding to the molded article of interest. During molding, the plug from the previous shot is expelled and caught in the sprue post portion 32. The alloy slurry then is injected into the sprue portion 34 and flows through the runner portion 36 past the gate portion 38. Beyond the gate portion 38, the alloy slurry flows into the part portion 40 for the article to be molded.

The mold 24 is preheated and the alloy slurry is injected into the mold 24 at a screw velocity ranging from about 0.5–5.0 m/s. Typically, the injection pressure is of the order of 25 kpsi. According to an embodiment of the present invention, molding occurs at a screw velocity approximately ranging from 0.7 m/s to 2.8 m/s. According to another embodiment of the present invention, molding occurs at a screw velocity approximately ranging from 1.0 m/s to 1.5 m/s. According to yet another embodiment of the present invention, molding occurs at a screw velocity approximately ranging from 1.5 m/s to 2.0 m/s. According to still another embodiment of the present invention, molding occurs at a screw velocity approximately ranging from 2.0 m/s to 2.5 m/s. According to yet another embodiment of the present invention, molding occurs at a screw velocity approximately ranging from 2.5 m/s to 3.0 m/s.

A typical cycle time per shot is 25 s, but may be extended up to 100 s. A gate velocity (mold-filling velocity) ranging from approximately 10 to 60 m/s is calculated for the range of screw velocities mentioned above. According to one embodiment, SSIM is performed at a gate velocity of approximately 10 m/s. According to another embodiment, SSIM is performed at a gate velocity of approximately 20 m/s. According to yet another embodiment, SSIM is performed at a gate velocity of approximately 30 m/s According to still another embodiment, SSIM is performed at a gate velocity of approximately 40 m/s. According to a preferred embodiment, SSIM is performed at a gate velocity of approximately 50 m/s. According to another embodiment, SSIM is performed at a gate velocity of approximately 60 m/s.

The mold-filling time, or time for a shot of the alloy slurry to fill the mold, is less than 100 ms (0.1 s). According to an embodiment of the present invention, the mold-filling time is approximately 50 ms. According to another embodiment of the present invention, the mold-filling time is approximately 25 ms. Preferably, the mold-filling time is approximately 25 to 30 ms.

After the mold 24 is filled with the slurry, the slurry undergoes a final densification, in which pressure is applied to the slurry for a short period of time, typically less than 10 ms, before the molded article is removed from the mold 24. The final densification is believed to reduce the internal porosity of the molded article. A short mold-filling time ensures that the slurry has not solidified, which would prevent a successful final densification.

Articles that were injection molded under different conditions encompassed in the present invention were examined using an optical microscope equipped with a quantitative image analyzer. The examined parts also include sprues and runners. Samples were polished with 3 $\mu$m diamond paste followed by a finishing polish using colloidal alumina. In order to reveal the contrast between microstructural features of the samples, the polished surfaces were etched in a 1% solution of nitric acid in ethanol. Internal porosity was determined by the Archimedes method, which is described in ASTM D792-9. For selected samples, phase composition was examined by X-ray diffraction using $Cu_{K\alpha}$ radiation.

Table 1 lists calculated mold-filling characteristics at various injection velocities of the screw portion 22. The listed characteristics were determined according to the following relationship:

$$V_g = V_s(S_s/S_g), \quad \text{(Eqn. 1)}$$

where $V_g$ is gate velocity, $V_s$ is the screw velocity, $S_s$ is the cross-sectional area of the screw, and $S_g$ is the cross-sectional area of the gate. The calculations assume a gate area of 221.5 $mm^2$ and a 100% efficiency of the non-return valve 26.

TABLE 1

Calculated Mold-Filling Characteristics

| Screw Velocity (m/s) | Gate Velocity (m/s) | Mold Cavity Filling Time (s) |
|---|---|---|
| 2.8 | 48.65 | 0.025 |
| 1.4 | 24.32 | 0.050 |
| 0.7 | 12.16 | 0.100 |

It is well established that semi-solid slurries exhibit both solid-like and liquid-like behavior. As a solid-like material, such slurries possess structural integrity; as a liquid-like material, they flow with relative ease. It is generally desirable to have such slurries fill a mold cavity in a laminar-flow manner, thus avoiding porosity caused by gases trapped in the slurry during turbulent flow, which is observed in articles molded from fully liquid material. (Laminar flow is commonly understood to be the streamline flow of a viscous, incompressible fluid, in which fluid particles travel along well-defined separate lines; and turbulent flow is commonly understood to be fluid flow in which fluid particles exhibit random motion.)

In contrast to conventional wisdom, the examples discussed below indicate that injection under laminar-flow conditions is not critical to achieving high-quality molded articles having a low internal porosity. Instead, a critical factor affecting the success of an ultra-high-solids-content SSIM process is the gate velocity during injection, which affects the mold-filling time. That is, it is important that the mold cavity be filled by the slurry while the slurry is in a semi-solid state, in order to avoid incomplete molding of articles caused by premature solidification. A suitably fast mold-filling time may be obtained by modifying the gate geometry to increase the cross-sectional area of the gate.

In order to assess the feasibility of SSIM of slurries of ultra-high solids contents (in excess of 60% and preferably ranging from 75% to 85%), the clutch housing shown in FIGS. 4*a* and 4*b* was injection molded from an AZ91D alloy. SSIM was performed using the parameters of Table 1.

EXAMPLE 1

Approximately 580 g of AZ91D alloy was required to fill a mold cavity for molding the clutch housing. The article itself contains approximately 487 g of material, and the sprue and runner contain approximately 93 g. For injection at a screw velocity of 2.8 m/s (gate velocity of 48.65 m/s and mold-filling time of 25 ms), compact parts were produced having a high surface-quality and precise dimensions. By partially filling the mold cavity (partial injection), it was revealed that at this screw velocity the flow front of the alloy slurry was turbulent. Unexpectedly, despite the turbulence, the internal porosity of the fully molded parts (full injection) had an acceptably low value of 2.3%, as discussed in more detail below. The results of this example show that, as long as the mold-filling time is sufficiently fast to achieve full injection while the slurry is still semi-solid, SSIM of slurries of ultra-high solids content can be used to produce high-quality molded articles, even under turbulent-flow conditions.

EXAMPLE 2

Under the same conditions as Example 1, but with a 50% reduction in the screw velocity (1.4 m/s), corresponding to a gate velocity of 24.32 m/s and a mold-filling time of 50 ms, premature solidification prevented the alloy slurry from completely filling the mold cavity. The weight of the molded article was 90% of that the fully molded article of Example 1. The majority of the unfilled areas was found to be situated at the outer edges of the article. A partial filling of the mold cavity revealed that the flow front improved in comparison with that of Example 1, but still was non-uniform and not completely laminar. This is especially evident in thin-walled regions, where local flow fronts moving from thicker regions solidified instantly after contacting the mold surface. Unexpectedly, despite the reduction in turbulence, the internal porosity of fully molded parts was higher than that measured for Example 1, and had an unacceptably high value of 5.3%. The results of this example show that, for SSIM of slurries of ultra-high solids contents, a reduction in gate velocity reduces the amount of turbulence in the flow of the slurry during injection, but was insufficient to produce a fully molded article of precise dimensions. Further, the reduced gate velocity resulted in an increase in porosity.

EXAMPLE 3

A further reduction of the screw velocity to 0.7 m/s (gate velocity of 12.16 m/s and mold-filling time of 100 ms) resulted in even less filling of the mold cavity than in Example 2. The molded article weighed 334.3 g, corresponding to 72% of the fully compact article of Example 1. A partial filling of the mold cavity revealed that the flow front in all regions, including thin-walled regions, was relatively uniform and laminar. The results of this example show that, for SSIM of slurries of ultra-high solids contents, a reduction in gate velocity to produce laminar-flow conditions was insufficient to produce a fully molded article of precise dimensions. The internal porosity of partially filled articles, however, had an extremely low value of 1.7%, consistent with injection under laminar-flow conditions.

A summary of the weights of the molded parts for Examples 1 through 3 is given in Table 2. The weight for the article itself is given as well as the total weight for the article with sprue and runner.

TABLE 2

Molded Weights At Various Screw Velocities

| | Screw Velocity (m/s) | Total Weight (g) | Article Weight (g) |
|---|---|---|---|
| Full Injection | 2.8 | 582 | 462.6 |
| Full Injection | 1.4 | 428 | 414.3 |
| Full Injection | 0.7 | 381 | 334.3 |
| Partial Inj. | 2.8 | 308 | 177.8 |
| Partial Inj. | 1.4 | 263 | 172.9 |
| Partial Inj. | 0.7 | 268 | 183.6 |

A 3 summary of the porosities of the samples from Examples 1 through is shown in Table 3. The internal porosity was measured by the Archimedes method, which revealed significant porosity differences between the samples. The porosity of the article itself and the porosity of the sprue and runner are listed.

TABLE 3

Porosity At Various Screw Velocities

| | Screw Velocity (m/s) | Article Porosity (%) | Sprue/Runner Porosity (%) |
|---|---|---|---|
| Full Injection | 2.8 | 2.3 | 4.6 |
| Full Injection | 1.4 | 5.3 | 6.1 |
| Full Injection | 0.7 | 1.7 | 0.2 |
| Partial Inj. | 2.8 | 7.4 | 2.6 |
| Partial Inj. | 1.4 | 17.4 | 7.7 |
| Partial Inj. | 0.7 | 3.1 | 4.0 |

An article porosity of 2.3% was observed for articles molded under full-injection conditions at a screw velocity of 2.8 m/s (gate velocity of 48.65 m/s). This value is sufficiently low to be within the acceptance limit of industry standards and is an unexpected result, because the flow front of the alloy slurry was determined to be turbulent, as discussed above. Turbulence is usually associated with an increase in porosity, but was not found to be significant for articles molded at this gate velocity. Thus, the porosity created at intermediate stages of the mold filling process was removed during final densification.

Surprisingly, a reduction in screw velocity to 1.4 m/s (gate velocity of 24.32 m/s and mold-filling time of 50 ms) caused an increase in article porosity to over 5%, which is generally beyond the acceptance limit. This finding indicates that the porosity created at intermediate stages of the mold filling process cannot be reduced, because the slurry solidifies before final densification can occur. A further reduction in screw velocity to 0.7 m/s (gate velocity of 12.16 m/s and mold-filling time of 100 ms) resulted in a very low article porosity of 1.7%, which is consistent with laminar flow-fronts, as mentioned above.

The sprue and runner porosity exhibited the same general trend as the article porosity under full-injection conditions.

The porosity of articles molded under partial-injection conditions was found to be significantly higher than the porosity of articles molded under full-injection conditions, even reaching two-digit numbers for a screw velocity of 1.4 m/s. An exception was found for a screw velocity of 0.7 m/s, which, similar to full-injection conditions, resulted in a low porosity within both the article and the sprue and runner.

The results described above indicate that a laminar flow-front is not required to be maintained during injection, in order to achieve a low-porosity product with a uniform microstructure. Turbulence is tolerable as long as the mold-filling time is low, typically below 0.05 s and preferably about 25 to 30 ms.

The structural integrity of molded articles was verified metallographically on cross sections at selected locations of the samples of Examples 1 through 3. Articles filled (molded) at a screw velocity of 2.8 m/s were found to be compact with no localized porosity evident on a macroscopic scale. The same was found for articles filled at a screw velocity of 0.7 m/s. (The porosity of articles filled at a screw velocity of 1.4 m/s, on a microscopic scale, is discussed below.) The results are consistent with those obtained by the Archimedes method (Table 3).

Figure 5:
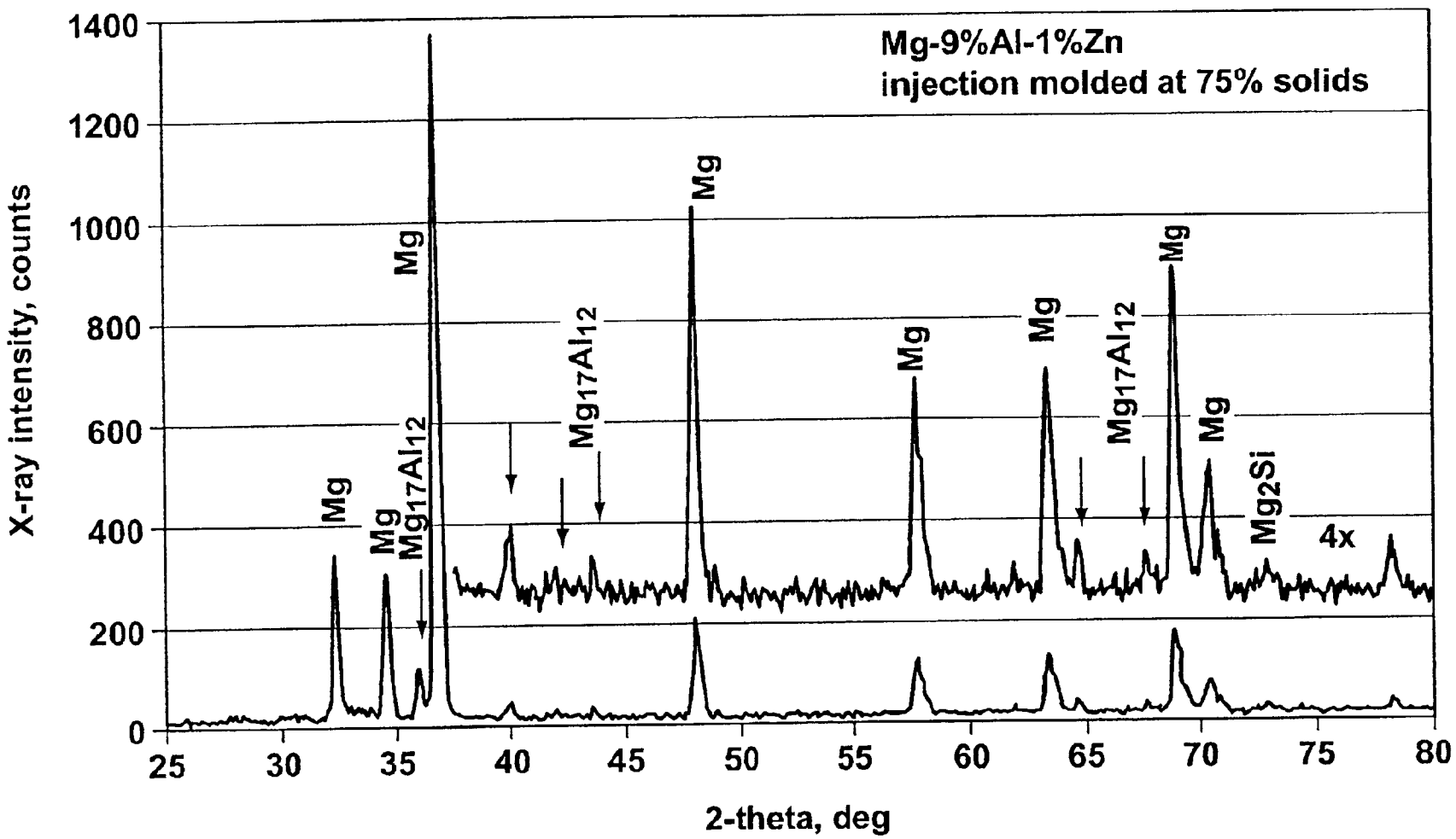
FIG. 5 shows an X-ray diffraction pattern of an article molded according to an embodiment of the present invention.

Phase composition was determined using X-ray diffraction (XRD) analysis of the samples of Examples 1 through 3. An XRD pattern, measured from an outer surface of an approximately 250 $\mu$m-thick section of an article molded at a screw velocity of 2.8 m/s, is shown in FIG. 5. In the XRD pattern, in addition to the strong peaks corresponding to Mg, which is characteristic of a solid solution of Al and Zn in Mg, several weaker peaks are present corresponding to the, phase ($Mg_{17}Al_{12}$). It is well established that some of the Al atoms in the phase are replaced by Zn and, at temperatures below 437° C., $Mg_{17}(Al,Zn)_{12}$ and possibly $Mg_{17}Al_{11.5}Zn_{0.5}$ intermetallics can form. Analysis of the angle location of XRD peaks did not reveal a significant shift due to a change in the lattice parameter as a result of the Al and Zn content in the intermetallics.

Due to an overlap of the major XRD peaks for $Mg_2Si$ (JCPDS 35-773 standard) with peaks for Mg and $Mg_{17}Al_{12}$, its presence cannot be unambiguously confirmed. In particular, the strongest $Mg_2Si$ peak, located at $2\theta$=40.121° coincides with a peak for $Mg_{17}Al_{12}$. Two other peaks at 47.121° and 58.028° overlap with the peaks for (102)Mg and (110)Mg, respectively. Thus, within the range examined, the only $Mg_2Si$ peak is at $2\theta$=72.117°, indicated in FIG. 5.

A comparison of the peak intensities of the Mg-based solid solution of the molded article with the JCPDS 4-770 standard indicates a random distribution of grain orientations. Similarly, the intensities of the $Mg_{17}Al_{12}$ peaks and the JCPDS-ICDD 1-1128 standard do not indicate any preferred crystallographic orientation of the intermetallic phase. Thus, XRD analysis indicates that the alloy of the molded article is isotropic, with the same properties extending in all directions. This feature is different from that reported for conventional cast alloys, where a skeleton of a solid dendritic phase is known to have a crystallographic texture (preferred orientation), resulting in non-uniform mechanical properties.

Figure 6A:
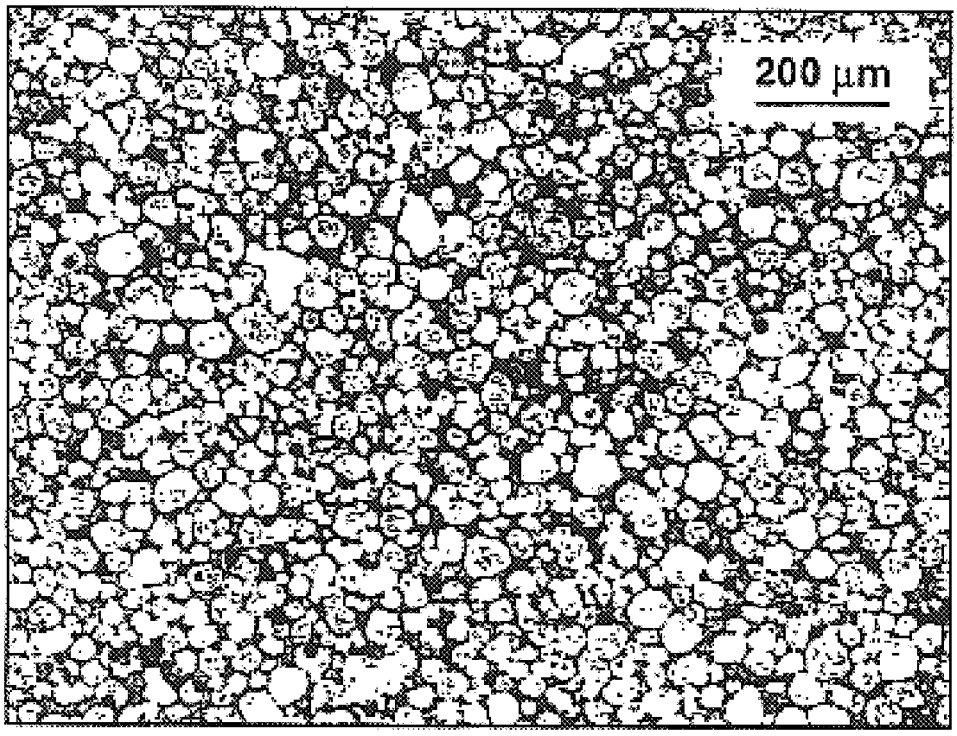
FIGS. 6*a* and 6*b* are optical micrographs showing the microstructure of an article molded according to an embodiment of the present invention.
Figure 6B:
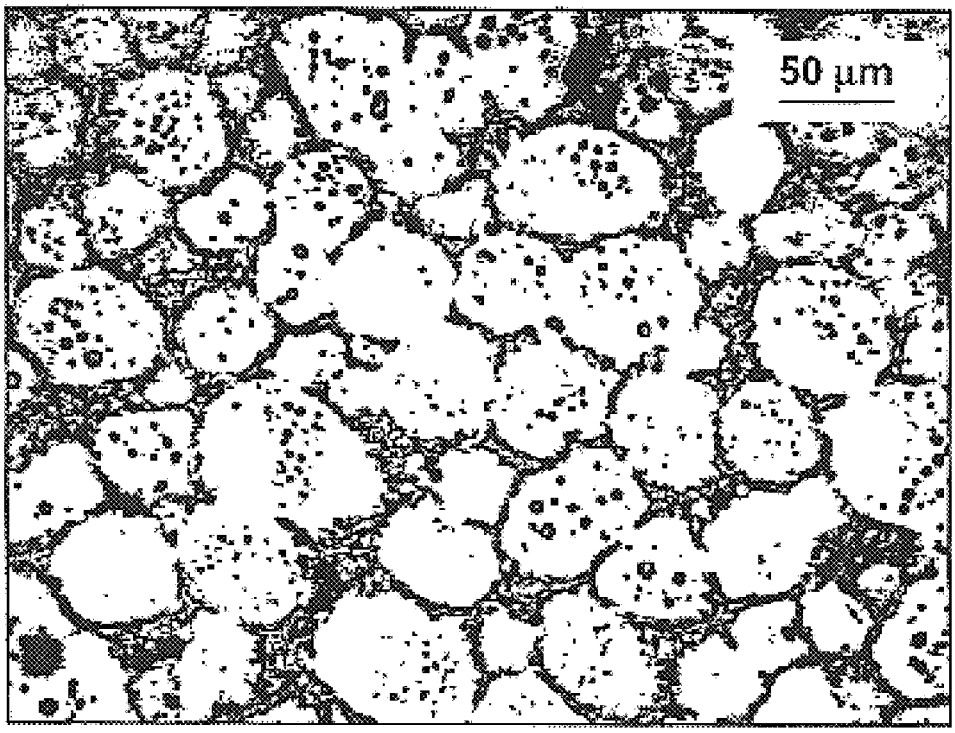

Optical micrographs of the phase distribution of microstructural constituents of an article molded at a screw velocity of 2.8 m/s are shown in FIGS. 6*a* and 6*b*. The nearly globular particles with a bright contrast represent a solid solution of $\alpha$-Mg. The phase with a dark contrast in FIG. 6*a* is the intermetallic $\gamma$-$Mg_{17}Al_{12}$. The distinct boundaries between the globular particles are comprised of eutectics and are similar to islands located at grain-boundary triple-junctions. Under high magnification, shown in FIG. 6*b*, a difference between the morphology of the eutectic constituents within the thin grain-boundary regions and the larger islands at triple-junctions can be seen. The difference is mainly in the shape and size of secondary $\alpha$-Mg grains.

The dark precipitates within solid globular particles, evident in FIG. 6*b*, are believed to be pure $\gamma$-phase intermetallics. The volume fraction of these precipitates corresponds to the volume fraction of the liquid phase during alloy residency within the barrel portion 12 of the injection-molding apparatus 10.

As evident from the micrographs of FIGS. 6*a* and 6*b*, the microstructure of the molded article is essentially porosity free. The dark features in FIG. 6*a* that could be mistakenly thought to be pores are, in fact, $Mg_2Si$, as clearly seen under higher magnification (FIG. 6*b*). This phase is an impurity remaining from a metallurgical rectification of the alloy, and has a Laves type structure. $Mg_2Si$, because it has a melting point of 1085° C., does not undergo any morphological transformation during semi-solid processing of the AZ91D alloy.

The predominant type of porosity observed in molded articles is normally from entrapped gas, presumably argon, which is the ambient gas during injection processing. Despite the ultra-high solids content (and thus low content of the liquid phase), the molded articles show evidence of a shrinkage porosity, formed as a result of contraction during solidification. Shrinkage porosity generally was observed near islands of eutectics, and porosity due to entrapped gas bubbles generally was observed to be randomly distributed.

A surface zone, approximately 150 $\mu$m thick, of an article and a runner molded at a screw velocity of 2.8 m/s was analyzed to determine the uniformity of their microstructures. The analysis revealed differences in particle distribution of the primary solid between the runner and the article, with a segregation of particles across the thickness of the surface zone. That is, particle segregation was observed in a region extending in a layer from the surface of the article to the interior of the article. The non-uniformity in particle distribution within the article was found to be larger than that within the runner.

A more homogeneous distribution of primary-solid particles was observed within articles molded at lower screw velocities.

Figure 7:
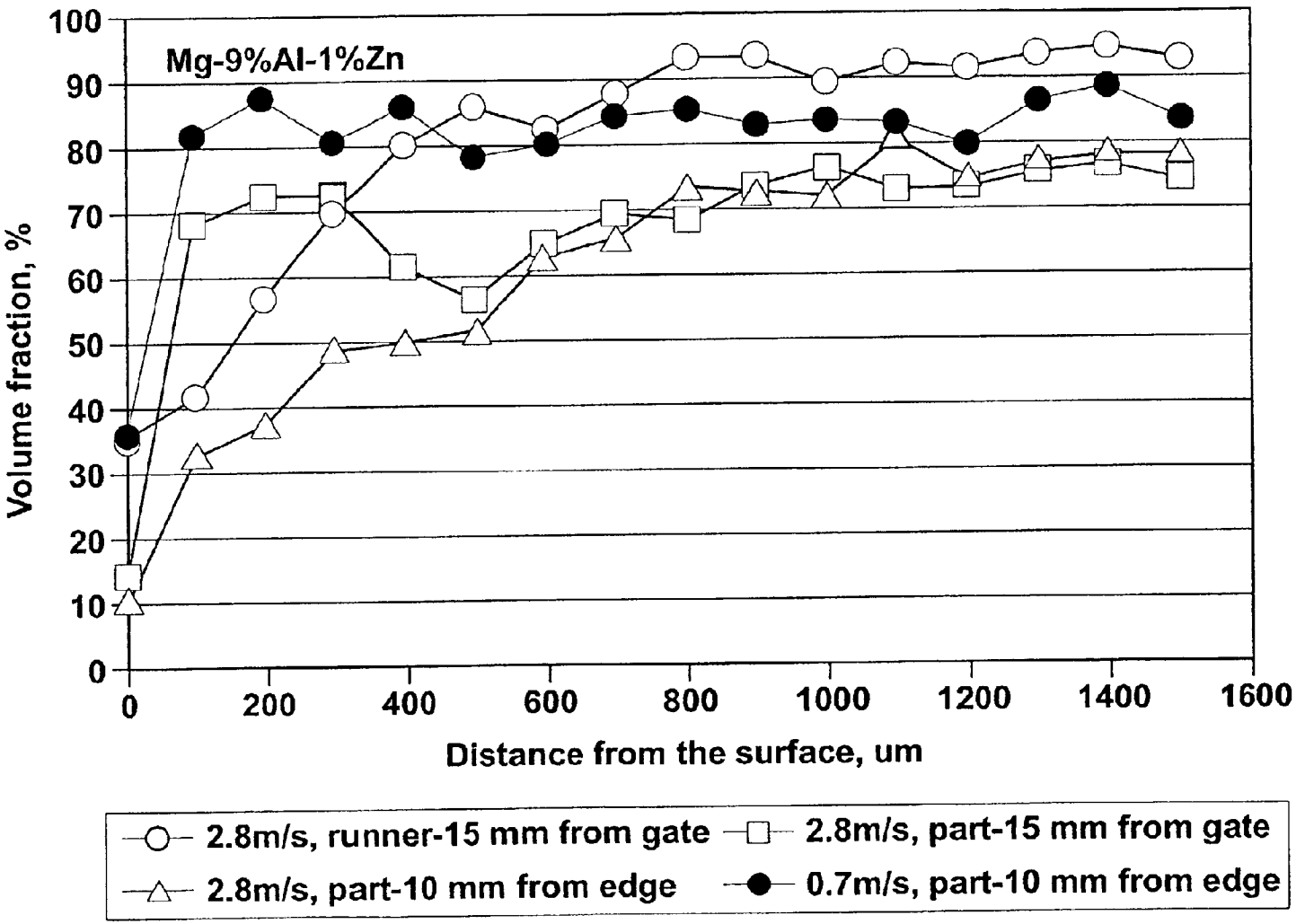
FIG. 7 shows a graph of the distribution of primary-solid particles as a function of distance from the surface of an article molded according to an embodiment of the present invention.

Stereological analysis was conducted on cross sections of molded articles to quantitatively assess particle segregation (distribution). The distribution of solid particles was measured as a function of distance from the surface of the article, using a linear method. The results are summarized in FIG. 7, which shows that the volume of primary-solid particles within the core of the molded article was constant at the level of 75–85%. The solids content within the runner was over 10% higher. Both the runner and the article itself contained less primary solid within the near-surface region (surface zone). The depleted surface zone was determined to be approximately 400 $\mu$m thick, but the majority of the depletion occurs within a 100 $\mu$m-thick surface layer.

In order to study changes in particle size and shape during flow of the semi-solid slurry through the mold gate, the slurry was injected into a partly open mold. This was observed to cause a significant increase in the gate size and wall thickness of the article and, as a result, only part of the mold cavity was filled. A typical microstructure for a roughly 5 mm thick section was found to be comprised of equiaxed grains with eutectics distributed along a grain-boundary network.

Figure 8:
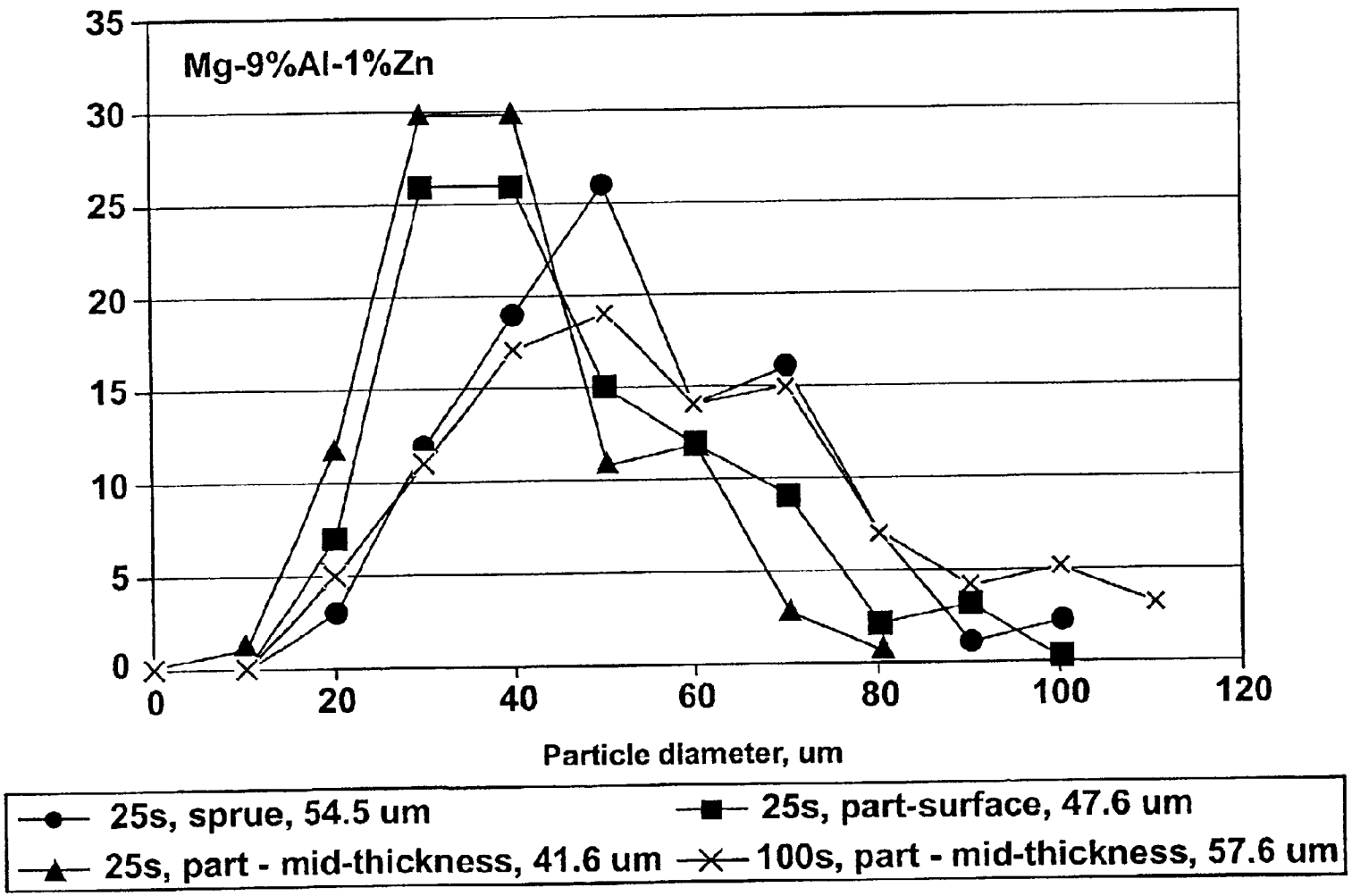
FIG. 8 shows a graph of the size distribution of primary-solid particles as a function of particle diameter.

The particle-size distribution of the solid particles of the molded articles was determined by measuring an average diameter on polished cross sections. The size distribution of particles for samples measured at various locations within a molded article and in a sprue is shown in FIG. 8. Also shown in FIG. 8 are particle-size distribution data for two different cycle times, showing its importance in controlling the size of particles in the molded article.

The primary α-Mg particle size was found to be affected by the residence time of the alloy slurry at the processing temperature. For Examples 1 through 3, the shot size required to fill the mold for the clutch housing had a typical residence time ranging from about 75–90 s in the barrel portion 12 of the injection-molding apparatus 10. An increase in residence time caused coarsening of the particle diameters of the primary solid, with a residence time of 400 s resulting in an increase in average particle size of 50%. FIG. 8 shows that an increase in cycle time (residence time) from 25 s to 100 s results in a significant increase in particle diameter, with some particles having diameters over 100 μm. The increase in particle size with an increase in cycle time indicates that coarsening takes place when the semi-solid slurry is resident within the barrel portion 12.

The effect of cooling rate on microstructure was also examined on sprues, because of their larger size. It was observed that for thick walls, such as those of sprues, the microstructure evolved much further than that for samples made from a partly open mold. Grain boundaries showed evidence of migration, and eutectics distributed along the grain boundaries changed morphology in comparison to samples made from a partly open mold.

Discussion of Observed Results

As demonstrated by the examples discussed above, injection molding of semi-solid magnesium alloys is possible even for ultra-high contents of solids. A solids content of the order of 75–85% is possible, which is above the range of 5–60% generally accepted for conventional injection-molding processes.

Although the above-described process is described with respect to semi-solid injection molding of Mg alloys, the process is also applicable to Al alloys, Zn alloys, and other alloys with melting temperatures below approximately 700° C. An important difference between Mg and Al alloys is in their density and heat content. The lower density of Mg compared with Al means that Mg has less inertia and, for the same applied pressure, a higher flow speed results. Therefore, it takes a shorter time to fill a mold with a Mg alloy than with an Al alloy.

Further, a difference in density between Mg and Al, accompanied by their similar specific heat capacities (1.025 kJ/kg K at 20° C. for Mg and 0.9 kJ/kg K at 20° C. for Al), means that the heat content of a Mg-based part will be substantially lower and will solidify faster than an Al-based pan of the same volume. This is of particular importance during processing of Mg alloys with an ultra-high fraction of solids. In this case, the solidification time is very short because only a small fraction of the alloy slurry is liquid. According to some estimations, for a 25–50% solids fraction, solidification takes place within one tenth of the time typically observed for high-pressure die casting. Accordingly, for an ultra-high solids content of 60–85%, the solidification time should be even shorter.

However, contrary to this conventional belief, a filling time of 25 ms was measured for a screw velocity of 2.8 m/s (Table 1), which does not entirely support this expectation, because the filling time is of the same order of magnitude as values measured for die casting. In fact, the calculated gate velocity of 48.65 m/s (Table 1) falls within a range of 30–50 m/s, which is typical for die casting of Mg alloys. This unexpected result can be explained by assuming that heat is generated during mold filling. Such a possibility is supported by observed microstructural changes, as discussed below.

Results from the partial filling of a mold cavity (partial injection) demonstrate that the flow mode of a semi-solid alloy slurry depends on both the percentage of solids in the slurry and the gate velocity, with the latter being controlled by the screw velocity and the geometry of the gate portion 38.

Although the presence of globular solid particles promotes laminar flow, even ultra-high solids contents do not prevent turbulent flow unless the gate velocity is adjusted (reduced) appropriately. A slurry with a solids content of 30%, injected at a gate velocity close to 50 m/s, exhibited highly turbulent flow characteristics. At a solids content of 75%, the flow front is still non-uniform (turbulent). This is caused by the fact that the gate velocity directly affects the mold-filling time, and is a critical factor in determining the success of the SSIM process. Thus, if the gate velocity is reduced excessively, the alloy slurry does not fill the mold cavity sufficiently quickly and, therefore, solidifies before completely filling the mold cavity, as demonstrated by Examples 1 through 3 above.

As discussed above, conventional wisdom holds that a laminar flow behavior of the alloy slurry is desired. A turbulent flow behavior not only creates internal porosity in the molded article (Table 3) by entrapping gases, but also increases the solidification rate by reducing the heat flow from the barrel portion 12 of the injection-molding apparatus 10 through the continuous stream of the alloy slurry. Also, it is well known that the higher the solids content of the slurry, the higher the injection (gate) velocity that may be employed before reaching the onset of turbulent flow behavior.

The samples discussed above, however, demonstrate that, despite the presence of an extremely high solids-content (exceeding 60% and preferable ranging from about 75–85%), the slurry can still exhibit turbulent flow behavior during injection, but the turbulence does not detrimentally affect the molded article. It is expected that flow problems can be solved by modifications to the gating system.

For gate velocities over 48 m/s (Example 1), laminar flow was sacrificed to achieve a sufficiently high injection velocity to completely fill the mold cavity. Nevertheless, a high-quality article with an acceptably low porosity was produced, even when turbulent behavior was observed for the slurry. This indicates that SSIM using ultra-high solids contents is flexible in terms of the slurry flow mode required to produce a high-quality product, as long as the mold filling time allows the mold to fill completely while the slurry is semi-solid. For a constant gate size, the mold-filling time is determined by the gate size. For the examples described above, the minimum gate velocity above which porosity decreases, even under turbulent flow conditions, is approximately 25 m/s. This is contrary to conventional beliefs about SSIM.

The significant difference in porosity between partially and completely filled articles molded at a gate velocity of 48.65 m/s, as indicated in Table 3, suggests that the porosity generated during mold filling is reduced during final densification. A successful final densification requires the slurry within the mold cavity to be semi-solid as the final pressure is applied. In order to achieve this, an appropriately short mold-filling time is required. At an intermediate gate velocity of 24.32 m/s, the flow mode was not laminar and the gate velocity was not high enough to completely fill the mold cavity. At a gate velocity of 12.16 m/s, a laminar flow mode was achieved, but the alloy solidified after filling only 72% of the mold cavity.

The role of shear is of particular importance to the process of the present invention. In contrast to situations involving low solids fractions, injection of slurries containing ultra-high solids fractions involves a continuous interaction between solid particles, including the sliding of solid particles relative to one another and the plastic deformation of solid particles. Such interaction between solid particles leads to a structural breakdown caused by shear forces and collisions, and also to structural agglomeration due to bond formation among particles, resulting from impingement and inter-particle reactions. It is likely that shear forces and the heat generated by those forces, are responsible for the success of SSIM of slurries of ultra-high solids contents.

SSIM of alloy slurries with an ultra-high solids content presents a number of processing issues, including: i) the minimum amount of liquid required to create a semi-solid slurry, and ii) the pre-heating temperature necessary to attain such a semi-solid state. In general, the melting of an alloy starts when the solidus temperature is exceeded. However, Mg—Al alloys are known to solidify in a non-equilibrium state and to form, depending on the cooling rate, various fractions of eutectics. As a result, the solidus temperature cannot be found directly from an equilibrium phase diagram. Also, complications arise from an incipient melting of Mg—Al alloys, typically occurring at 420° C. If the Mg—Al alloy has a Zn content that is sufficiently high to create a three-phase region, a ternary compound is formed and incipient melting may occur at a temperature as low as 363° C.

For a composition of Mg-9% Al-1% Zn, the AZ91D alloy, the solidus and liquidus temperatures are 468° C. and 598° C., respectively. Under equilibrium conditions, the eutectic occurs at a composition of approximately 12.7 wt. % Al. Thus, molded structures that contain $Mg_{17}Al_{12}$ are considered to be in a non-equilibrium state, and this is essentially true for a wide range of cooling rates accompanying solidification.

Figure 9:
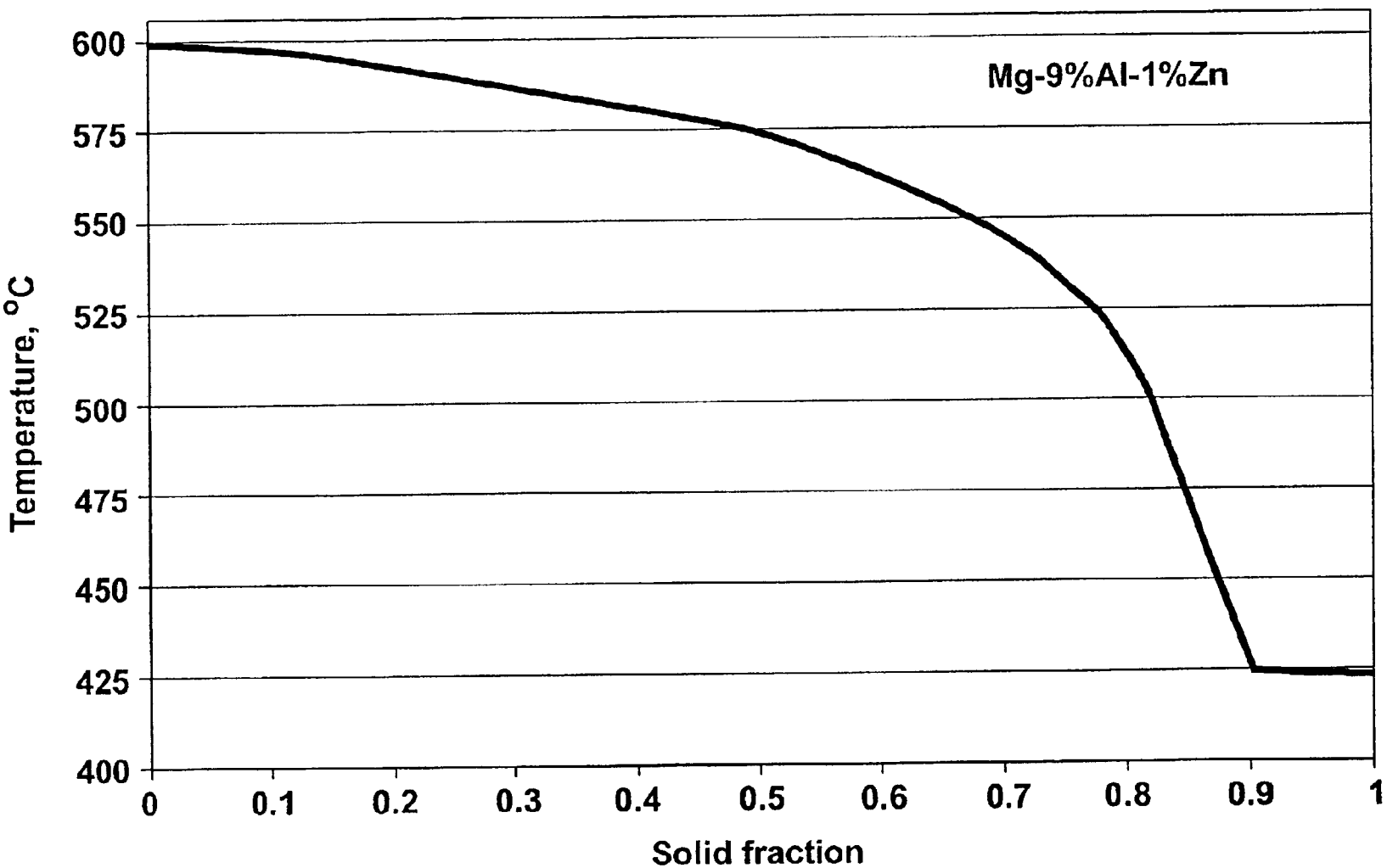
FIG. 9 shows a graph relating the fraction of solids in a magnesium alloy as a function of temperature.

The temperature required to achieve a certain content of a liquid can be estimated based on Scheil's formula. Assuming non-equilibrium solidification, which translates to negligible solid-state diffusion, and assuming perfect mixing of the liquid, the fraction of solids $f_s$ is given by:

$$f_s=1-\{(T_m-T)/m_1C_0\}^{-1/(1-k)}, \quad \text{(Eqn. 2)}$$

where $T_m$ is the melting point of pure component, $m_1$ is the slope of the liquidus line, k is the partition coefficient, and $C_0$ is the alloying content. FIG. 9 is a diagram showing the relationship between temperature and the fraction of solids in a AZ91D alloy.

Theoretical calculations predict a maximum solids fraction of 64% as the random-packing limit for spherical particles, and even small deviations from the spherical shape will depress this limit. However, the results discussed above indicate that, for the AZ91D alloy, the amount of former liquid within the molded article is significantly lower than the theoretical packing limit. In fact, it is only slightly higher than the volume fraction of eutectics of 12.4% usually observed for Mg-9% Al alloys. This phenomenon is believed to result from the fact that near-globular forms evolve from the equiaxed-grain precursor of recrystallized alloy chips, by melting of the γ phase at triple junctions and α-Mg/α-Mg grain boundaries. During slow solidification, the globular forms returned to an equiaxed grain structure.

The microstructure of articles injection molded from slurries with ultra-high solids contents is substantially different from that obtained from slurries of low and medium solids contents. For the Mg alloy discussed above, an ultra-high solids content results in a microstructure that is predominantly globular particles of primary α-Mg interconnected by a transformation product of the former liquid, with the primary α-Mg practically occupying the entire volume of the molded article, and with eutectics formed of a mixture of secondary α-Mg and the γ phase being distributed only along particle boundaries and at triple junctions. The microstructure is fine-grained with the average diameter of an α-Mg particle being approximately 40 μm, which is smaller than that generally observed for slurries containing 58% solids.

As shown in FIG. 8, the short residence time of the alloy slurry within the barrel portion 12 of the injection-molding apparatus 10 is crucial in controlling particle size. The short residency of the slurry at high temperatures while in the solid state prevents grain growth following recrystallization. Because there are no effective blockades that would hinder grain-boundary migration in Mg-9% A1-1% Zn alloys, grains can grow easily if left for extended periods of time at elevated temperatures.

Solid particles can also grow while suspended in a liquid alloy. The semi-solid alloy slurry resident in the barrel portion 12 of the injection-molding apparatus 10 undergoes coarsening of the solid particles by coalescence mechanisms and Ostwald ripening. Coalescence is defined as the nearly instantaneous formation of one large particle upon contact of two small particles. Ostwald ripening is governed by the Gibbs-Thompson effect, which is the mechanism by which grain growth occurs due to concentration gradients at the particle-matrix (liquid) interface. The curvature of the interface creates concentration gradients, which drive the diffusional transport of material. However, the short residence time of the process of the present invention, which reduces diffusion effects, is believed to diminish the role of Ostwald ripening. Therefore, the leading mechanism behind particle coarsening is believed to be coalescence.

An interesting finding of the microstructural analysis discussed above is the lower solids content within the molded article compared with the runner. In particular, a monotonic reduction in solids content was observed as a function of the distance from the mold gate, for a near-surface zone of the molded article. Although cross-sectional segregation can be explained by changes in flow behavior due to differences in density between solid Mg (1.81 g/cm$^3$) and liquid Mg (1.59 g/cm$^3$), the lower observed average solids content within the article compared with the runner suggests that another mechanism may be more appropriate.

A segregation of the liquid phase is often observed when solid grains deviate substantially from a spherical form or when the fraction of solids is large. Under such circumstances solid grains do not move together with the liquid, but instead the liquid moves substantially with respect to the solid grains. This scenario, however, cannot be entirely adopted to explain the microstructure of articles molded from slurries with ultra-high solids contents, because of the observed dependence of article characteristics on the screw velocity used to mold the article. Instead, it is believed that shear forces, arising from the movement of slurries with ultra-high solids contents through the gate and within the mold cavity, generates heat that contributes to melting of the alloy. Without the presence of shear forces, it is believed that it would be impossible to completely fill the mold cavity.

The examples described above were processed using an existing gating system with a geometry and dimensions optimized for other processes. A requirement of a short mold-filling time and a high screw velocity indicates that existing gating systems may be modified to perform injection molding of high-quality articles from alloy slurries of ultra-high solids content, including elimination of the sprue portion 34, which is an obstacle to the rapid transport of the slurry to the gate portion 38. Another possibility is an increase in the gate size.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An injection-molding process comprising the steps of:

heating an alloy to create a semi-solid slurry with a solids content ranging from about 60% to about 85%;

injecting the slurry through a gate portion of a mold cavity at a gate velocity sufficient to i) configure an injection flow front in the mold cavity that is at least partially turbulent and ii) that is sufficient to substantially fill the mold cavity; and densifying the slurry after the slurry has been injected into the mold cavity, wherein the slurry is in a semi-solid state during densification.

2. The injection-molding process according to claim 1, wherein, in the injecting step, the slurry fills the mold cavity in about 25 to about 100 ms.

3. The injection-molding process according to claim 1, wherein, in the injecting step, the slurry fills the mold cavity in about 25 to about 50 ms.

4. The injection-molding process according to claim 1, wherein, in the injecting step, the slurry fills the mold cavity in about 25 to about 30 ms.

5. The injection-molding process according to claim 1, wherein the alloy is chips of a magnesium-based alloy.

6. The injection-molding process according to claim 5, wherein the alloy is chips of a magnesium-aluminum-zinc alloy.

7. The injection-molding process according to claim 1, wherein the gate velocity ranges from about 50 m/s to about 60 m/s.

8. The injection-molding process according to claim 1, wherein the gate velocity ranges from about 40 m/s to about 50 m/s.

9. The injection-molding process according to claim 1, wherein the solids content ranges from about 60% to about 75%.

10. The injection-molding process according to claim 1, wherein the solids content ranges from about 75% to about 85%.

11. The injection-molding process according to claim 1, wherein the alloy is chips of an aluminum-based alloy.

12. The injection-molding process according to claim 1, wherein the alloy is chips of a zinc-based alloy.

13. The injection-molding process according to claim 1, wherein shear forces are created within the slurry during injection.

14. The injection-molding process according to claim 1, wherein the heating of the alloy is sufficient to create a semi-solid slurry with a solids content ranging from about 75% to about 85%.

15. An injection-molding process comprising the steps of:

providing chips of a magnesium-aluminum-zinc alloy;

heating the chips to a temperature between a solidus temperature and a liquidus temperature of the alloy to create a semi-solid slurry with a solids content ranging from about 75% to about 85%;

injecting the slurry through a gate portion of a mold cavity at a gate velocity appropriate to i) configure an injection flow front in the mold cavity that is at least partially turbulent and ii) that is sufficient to substantially fill the mold cavity before the slurry solidifies; and densifying the slurry after the slurry has been injected into the mold cavity, wherein the slurry is in a semi-solid state during densification.

16. The injection-molding process according to claim 15, wherein, in the injecting step, the slurry fills the mold cavity in about 25 to about 100 ms.

17. The injection-molding process according to claim 15, wherein, in the injecting step, the slurry fills the mold cavity in about 25 to about 50 ms.

18. The injection-molding process according to claim 15, wherein, in the injecting step, the slurry fills the mold cavity in about 25 to about 30 ms.

19. The injection-molding process according to claim 15, wherein shear forces are created within the slurry during injection.

20. The injection-molding process according to claim 15, wherein the gate velocity ranges from about 50 m/s to about 60 m/s.

21. The injection-molding process according to claim 15, wherein the gate velocity ranges from about 40 m/s to about 50 m/s.

* * * * *